US005288038A

United States Patent [19]

Duong

[11] Patent Number: 5,288,038

[45] Date of Patent: Feb. 22, 1994

[54] KITE

[76] Inventor: Long Duong, 21, Square General Paris De La Bollardiere, 35700 Rennes, France

[21] Appl. No.: 954,581

[22] Filed: Sep. 30, 1992

[51] Int. Cl.[5] ..... B64C 31/06

[52] U.S. Cl. ..... 244/153 R

[58] Field of Search ..... 244/153 R, 901

[56] References Cited

U.S. PATENT DOCUMENTS 3,241,793 3/1966 Curtis et al. ..... 244/153 R 4,807,832 2/1989 Tabor ..... 244/153 R

FOREIGN PATENT DOCUMENTS 2705195 8/1977 Fed. Rep. of Germany ..... 244/901

*Primary Examiner*—Galen L. Barefoot

*Attorney, Agent, or Firm*—Laff, Whitesel, Conte & Saret

[57] ABSTRACT

A delta type kite that comprises a sail (T) mounted on a chord constituted by a central longitudinal rod (C), two lateral rods (L) and two tension rods (1). Each of the tension rods has an end coupled to a nose (N) of the kite and in contact with the sail (T). The kite also includes a rear transverse rod (5) and a front transverse rod (9) in a plane which is lower than a plane containing the sail (T). There are also rear stiffeners connecting the tension rods (1) to the transverse rods (5,9). The kite has two front stiffeners (11) individually coupled to the two transverse rods to give the sail (T) an airplane wing shape.

5 Claims, 1 Drawing Sheet

KITE

The present invention relates to a kite of the dirigible type.

Dirigible kites generally are made up of a sail, mounted on a chord either in a flexible manner or, on the contrary, in a taut manner.

Kites with taut sail comprise a tension system that makes it possible to tauten the sail. When a kite of that type develops an important speed, its sail becomes very taut, this making it fragile in case of shocks.

Besides, when the wind is strong or blows in gales, the chord is subjected to critical torsion stresses that may cause it to break.

Finally, the too rigid assembly imparts to the flight a bumpy course when the wind blows in gales. The kite then becomes difficult to control and its patterns and trajectories loose their qualities of precision and of constancy of speed.

Now, it has been possible to observe that this results from the fact that the tension system is mounted in a fixed and nonmovable manner on the chord.

One purpose of the present invention therefore is to propose a kite that remedies the above-mentioned problems, and that thus acquires higher capabilities of flying speed, of precision in the figures made, of flight constancy and of resistance to shocks.

To that end, a kite according to the present invention is remarkable in that its tension system comprises two tensions rods that start from the nose of the kite, in contact with said sail, a rear cross rod and a front cross-rod in a plane lower than the plane that contains said sail, the above-mentioned tension rods being connected to said cross-rods by stiffeners provided to permit a relative displacement between the cross-rods and the oblique rods.

According to another characteristic of the invention, it comprises two front stiffeners, each one constituted by a rigid rod one end of which is welded to an elastic support taking its support on the corresponding tension rod and the other end of which is mounted on the front cross-rod.

According to another characteristic of the invention, that invention comprises rear stiffeners constituted, each one of them by a shaft affixed to the corresponding tension rod, and by a rod arranged so that it can slide inside said shaft, the end of this last rod being mounted on the rear cross rod.

The characteristics of the invention that have been mentioned above, as well as others, will appear more clearly at the reading of the following description of one example of execution, that description being given with respect to the attached drawing in which.

Figure 1:
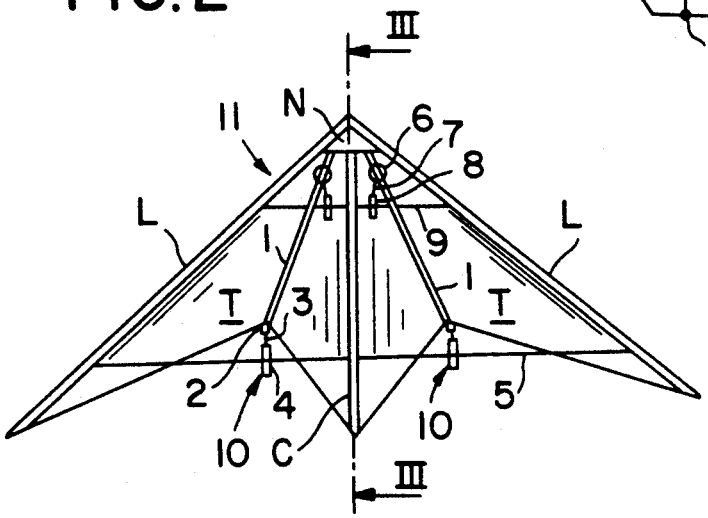
FIG. 1 is a view from underneath of a kite equipped with a tension system according to the present invention.

The kite shown in FIG. 1 comprises a sail V mounted, in a manner known by the man of the art, on a chord essentially constituted by a central longitudinal rod C and by two lateral rods L the front ends of which are connected to the nose N of the kite, at the fore end of the central rod. The lateral rods L form a somewhat triangular of V-shape between them.

The tension system of the sail V is made up of two tension rods 1, the front ends of which are connected, at the nose N of the kite, to the front ends of the central and lateral rods. The tension rods 1 form between them a somewhat triangular or V-shape. The tension system further comprises a rear transverse rod 5 the ends of which are respectively affixed to the lateral rods L, and of a front transverse rod 9 the ends of which also are respectively affixed to the lateral rods L.

When the kite is mounted, the slanted rods 1 are in contact with the sail T while the rear 5 and front 9 transverse rods are not in the same plan as the sail, but at a lower level.

Figure 2:
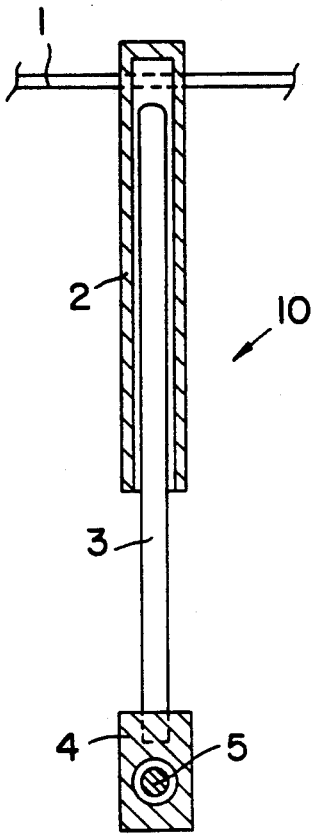
FIG. 2 is a section view of a rear stiffener that equips the tension system.

In order to connect the oblique rods 1 and the rear rod 9 and thus to tauten the rear part of the sail V, there are provided two rear stiffeners symmetrically mounted relative to the central rod C. Such a stiffener is shown in detail in FIG. 2. It comprises a hollow shaft 2 through the upper part of which there runs the corresponding rod 1. It also comprises a rigid telescoping rod 3 which slides inside shaft 2, a base support 4 to which the free end of the rod 3 is affixed and into which there is introduced the rear transverse rod 5. The base support 4 thus can pivot around bar 5.

Figure 3:
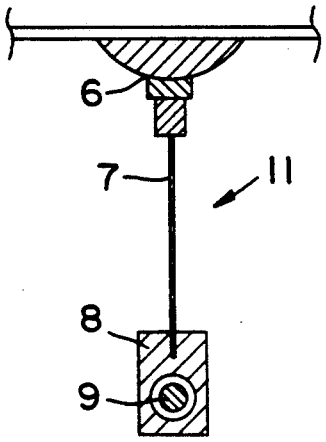
FIG. 3 is a section view of a front stiffener that equips the tension system.

In order to connect the oblique rods 1 with the transverse rod 9, there are provided two front stiffeners symmetrically assembled relative to the central rod C. Such a stiffener is shown in detail in FIG. 3. It comprises a rigid rod 7 welded to a support 6 that takes its support on rod 1. Support 6 advantageously is made of rubber in order to play the part of a damper. The free end of rod 7 is welded to a base support 8 pierced throughout with a hole the diameter of which is slightly greater than that of bar 9 so that the latter can be introduced into it.

By separating support 6 from rod 1, it is possible to release rod 7 and to cause it to pivot around bar 9. This makes it possible to fold the kite for its storage.

Figure 4:
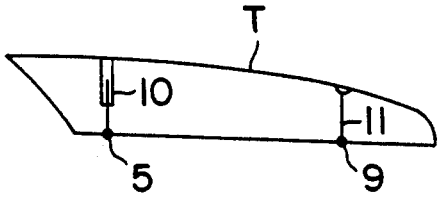
FIG. 4 is a section view of the invention cut along line III—III in FIG. 1.

In order to set up the kite after its sail has been unfolded, the stiffeners are set into place by simple pivoting of the rods 7, this having as its result to raise the head of the kite, by tension, thus giving a convex (bombé) head visible in FIG. 4.

The advantage of the tension system according to the present invention is that it can dampen the gusts of wind that unbalance the kite and cause its flight to be bumpy. It also is an increase in the speed of the kite. Moreover, there has been observed a constant flight quality and higher qualities of precision in the trajectory and in the figures assigned to the kite.

In practice, this tension system efficiently protects the kite against all shocks and against the stresses resulting from gusts of wind.

I claim:

1. A delta type kite that comprises a sail (T) mounted on a chord constituted by a central longitudinal rod (C), two lateral rods (L), two tension rods (1), each of said tension rods having an end coupled to a nose (N) of the kite and in contact with said sail (T), a rear transverse rod (5) and a front transverse rod (9) in a plane which is lower than a plane containing said sail (T), rear stiffeners connecting said tension rods (1) to said transverse rods (5, 9) said kite having two front stiffeners (11) individually coupled to said two transverse rods to give said sail (T) an airplane wing shape (FIG. 4).

2. The kite according to claim 1, wherein each of the two front stiffeners (11) is constituted by a rigid rod (7) having one end welded to an elastic support (6) that is supported by the corresponding tension rode (1), and the other end of said front stiffener is mounted on the front transverse rod (9).

3. A kite according to claim 2, wherein each rigid rod (7) is pivotally mounted on the front transverse rod (9).

4. A kite according to any of one of the preceding claims, and two rear stiffeners (10), each rear of said rear stiffeners having a hollow shaft (2) affixed to the corresponding tension rods (1) and two telescoping rods (3) having one end mounted to slide inside said shaft (2), the other end of said telescoping rods (3) being mounted on the rear transverse rod (5).

5. A kite according to claim 4, wherein each telescoping rod (3) is pivotly mounted on the rear transverse rod (5).

* * * * *